US008244505B2

(12) United States Patent
Headley et al.

(10) Patent No.: US 8,244,505 B2
(45) Date of Patent: Aug. 14, 2012

(54) PREDICTING $NO_x$ EMISSIONS

(75) Inventors: Christopher Damien Headley, Schenectady, NY (US); Brian Stephen Noel, Morrow, OH (US)

(73) Assignee: General Electric Company, Schenectady, NY (US)

( * ) Notice: Subject to any disclaimer, the term of this patent is extended or adjusted under 35 U.S.C. 154(b) by 318 days.

(21) Appl. No.: 12/612,897

(22) Filed: Nov. 5, 2009

(65) Prior Publication Data

US 2011/0106506 A1 May 5, 2011

(51) Int. Cl.
*G06F 7/60* (2006.01)
*G06G 7/48* (2006.01)
*F01N 3/00* (2006.01)

(52) U.S. Cl. ..... 703/2; 703/6; 703/12; 60/287

(58) Field of Classification Search ..... 703/1, 6, 703/12; 60/287

See application file for complete search history.

(56) References Cited

U.S. PATENT DOCUMENTS 4,115,515 A * 9/1978 Tenner et al. ..... 423/235
4,302,205 A * 11/1981 Muraki et al. ..... 436/55
4,313,300 A * 2/1982 Wilkes et al. ..... 60/775
5,356,487 A * 10/1994 Goldstein et al. ..... 136/253
5,539,638 A * 7/1996 Keeler et al. ..... 701/32.9
5,569,312 A * 10/1996 Quirk et al. ..... 65/134.6
5,573,568 A * 11/1996 Quirk et al. ..... 65/134.6
6,227,842 B1 * 5/2001 Lemelson et al. ..... 431/12
6,453,830 B1 * 9/2002 Zauderer ..... 110/345
6,775,623 B2 * 8/2004 Ali et al. ..... 702/31
7,374,736 B2 * 5/2008 Payne et al. ..... 423/235
7,421,348 B2 * 9/2008 Swanson ..... 702/32
7,647,204 B2 * 1/2010 Hanson et al. ..... 702/182
7,690,201 B2 * 4/2010 Kravets ..... 60/653
2003/0125999 A1 * 7/2003 Kobayashi et al. ..... 705/7
2003/0134241 A1 * 7/2003 Marin et al. ..... 431/9
2004/0244361 A1 * 12/2004 Tanabe et al. ..... 60/274
2006/0106501 A1 * 5/2006 Gomer et al. ..... 700/286
2006/0177785 A1 * 8/2006 Varagani et al. ..... 431/12
2009/0070047 A1 * 3/2009 Swanson ..... 702/32
2011/0094209 A1 * 4/2011 Charial ..... 60/287

OTHER PUBLICATIONS

40 C.F.R. 60.48b(f), 2007.*
40 CFR Parts 72 and 75, Aug. 2002.*
Cremer et al., CFD Evaluation of Oxygen Enhanced Combustion Impacts on NOx Emissions, Carbon-in-Flyash and Waterwall Corrosion, 2003.*
Ahn, Kyoungho. "Microscopic Fuel Consumption and Emission Modeling", 1998.*
England et al. "Hazardous air pollutant emissions from gas-fired combustion sources: emissions and the e∈ects of design and fuel type", Chemosphere 42 (2001) 745-764.*

(Continued)

*Primary Examiner* — Shambhavi Patel
(74) *Attorney, Agent, or Firm* — Hoffman Warnick LLC; Ernest Cusick

(57) ABSTRACT

A method of predicting a nitrogen oxide ($NO_x$) emission rate of a non-continuous, natural gas-fired boiler is presented. The method includes: calculating a correlation of the $NO_x$ emission rate to a measured fuel flow rate and a sampled oxygen ($O_2$) concentration based on a plurality of sampled $NO_x$ emission concentrations, measured fuel flow rates, and sampled ($O_2$) concentrations during operation of the non-continuous, natural gas-fired boiler using a computing device; calculating a predicted $NO_x$ emission rate based on the correlation with the measured fuel flow rate and the sampled $O_2$ concentration using the computing device; and providing the predicted $NO_x$ emission rate for use by a user.

14 Claims, 5 Drawing Sheets

OTHER PUBLICATIONS

Habib et al. "Influence of combustion parameters on NOx production in an industrial boiler", Computers & Fluids 37 (2008) 12-23.*
Lee et al. "Application of Multivariate Statistical Models to Prediction of NOx Emissions from Complex Industrial Heater Systems", 2005.*
Lerdpatchareekul et al. "Emissions from an industrial fuel oil/gas-fired steam boiler ", Proceedings of the 2nd Regional Conference on Energy Technology Towards a Clean Environment Feb. 12-14, 2003.*
Macak, Joseph. "The Pros and Cons of Predictive, Parametric, and Alternative Emissions Monitoring Systems for Regulatory Compliance", 1996.*
Mullins et al. "Prediction and Minimisation of NOx Emissions from Industrial Furnaces Using PCA", 2007.*
Muzio et al. "Implementing NOx Control: Research to Application", Prog. Energy Combust. Sci. vol. 23, p. 233-266, 1997.*
Stipa et al. "Emissions of NOx From Baltic Shipping and First Estimates of Their Effects on Air Quality and Eutrophication of the Baltic Sea", 2007.*
"Alternative Control Technologies Document NOx Emissions from Utility Boilers", 1994.*
Walsh, Allan. "Optimizing CO and Nox Emissions from Hog Fuel Boilers", 2007.*
Xu et al. "Modelling of the combustion process and NOx emission in a utility boiler", Fuel 79 (2000) 1611-1619.*
Yuan, Jerry. "Prediction of NOx Emissions in Recovery Boilers—An Introduction to NOx Module", Apr. 1999.*

* cited by examiner

PREDICTING $NO_x$ EMISSIONS

BACKGROUND OF THE INVENTION

The invention relates generally to monitoring nitrogen oxide ($NO_x$) emissions. More particularly, the invention relates to predicting $NO_x$ emission rates from a natural gas-fired boiler, and a method for monitoring and/or reporting $NO_x$ emission rates that conforms to state and federal guidelines, and other regulations for the aforementioned.

$NO_x$ is the generic term for a group of highly reactive gases, all of which contain nitrogen and oxygen in varying amounts. Many of the nitrogen oxides are colorless and odorless. However, one common pollutant, nitrogen dioxide ($NO_2$) along with particles in the air can often be seen as a reddish-brown layer over many urban areas. Nitrogen oxides form when fuel is burned at high temperatures, as in a combustion process. The primary sources of $NO_x$ are motor vehicles, electric utilities, and other industrial, commercial, and residential sources that burn fuels. Combustion boilers are used globally and produce $NO_x$ as a byproduct.

BRIEF DESCRIPTION OF THE INVENTION

A first aspect of the disclosure provides a method for predicting a nitrogen oxide ($NO_x$) emission rate of a non-continuous, natural gas-fired boiler, the method comprising: calculating a correlation of the $NO_x$ emission rate to a measured fuel flow rate, and a sampled oxygen ($O_2$) concentration based on a plurality of sampled $NO_x$ emission concentrations, measured fuel flow rates and sampled ($O_2$) concentrations during operation of the non-continuous, natural gas-fired boiler using a computing device; calculating a predicted $NO_x$ emission rate based on the correlation with the measured fuel flow rate and the sampled $O_2$ concentration using the computing device; and providing the predicted $NO_x$ emission rate for use by a user.

A second aspect of the disclosure provides a predictive monitoring system for a nitrogen oxide ($NO_x$) emission rate comprising: at least one device including: a calculator for calculating a correlation of the $NO_x$ emission rate to a measured fuel flow rate and a sampled oxygen ($O_2$) concentration based on a plurality of sampled $NO_x$ emission concentrations, measured fuel flow rates, and sampled $O_2$ concentrations during operation of a non-continuous, natural gas-fired boiler; and a calculator for calculating a predicted $NO_x$ emission rate based on the correlation of the measured fuel flow rate and the sampled $O_2$ concentration.

A third aspect of the disclosure provides a computer program comprising program code embodied in at least one computer-readable medium, which when executed, enables a computer system to implement a method of predicting a nitrogen oxide ($NO_x$) emission rate of a non-continuous, natural gas-fired boiler, the method comprising: calculating a correlation of the $NO_x$ emission rate to a measured fuel flow rate, and a sampled oxygen ($O_2$) concentration based on a plurality of sampled $NO_x$ emission concentrations, measured fuel flow rates, and sampled ($O_2$) concentrations during operation of the non-continuous, natural gas-fired boiler using a computing device; calculating a predicted $NO_x$ emission rate based on the correlation with the measured fuel flow rate and the sampled $O_2$ concentration using the computing device; and providing the predicted $NO_x$ emission rate for use by a user.

Other aspects of the invention provide methods, systems, program products, and methods of using and generating each, which include and/or implement some or all of the actions described herein. The illustrative aspects of the invention are designed to solve one or more of the problems herein described and/or one or more other problems not discussed.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide a predicted nitrogen oxide ($NO_x$) emission rate. As used herein, unless otherwise noted, the term "set" means one or more (i.e., at least one) and the phrase "any solution" means any now known or later developed solution.

Because of the harmful nature of $NO_x$ gasses, federal law requires the monitoring of $NO_x$ gasses, and how the data is recorded and reported. Meeting federal and state law mandates, and global regulations regarding the aforementioned requires a large amount of time and effort, and consequently is expensive.

Figure 1:
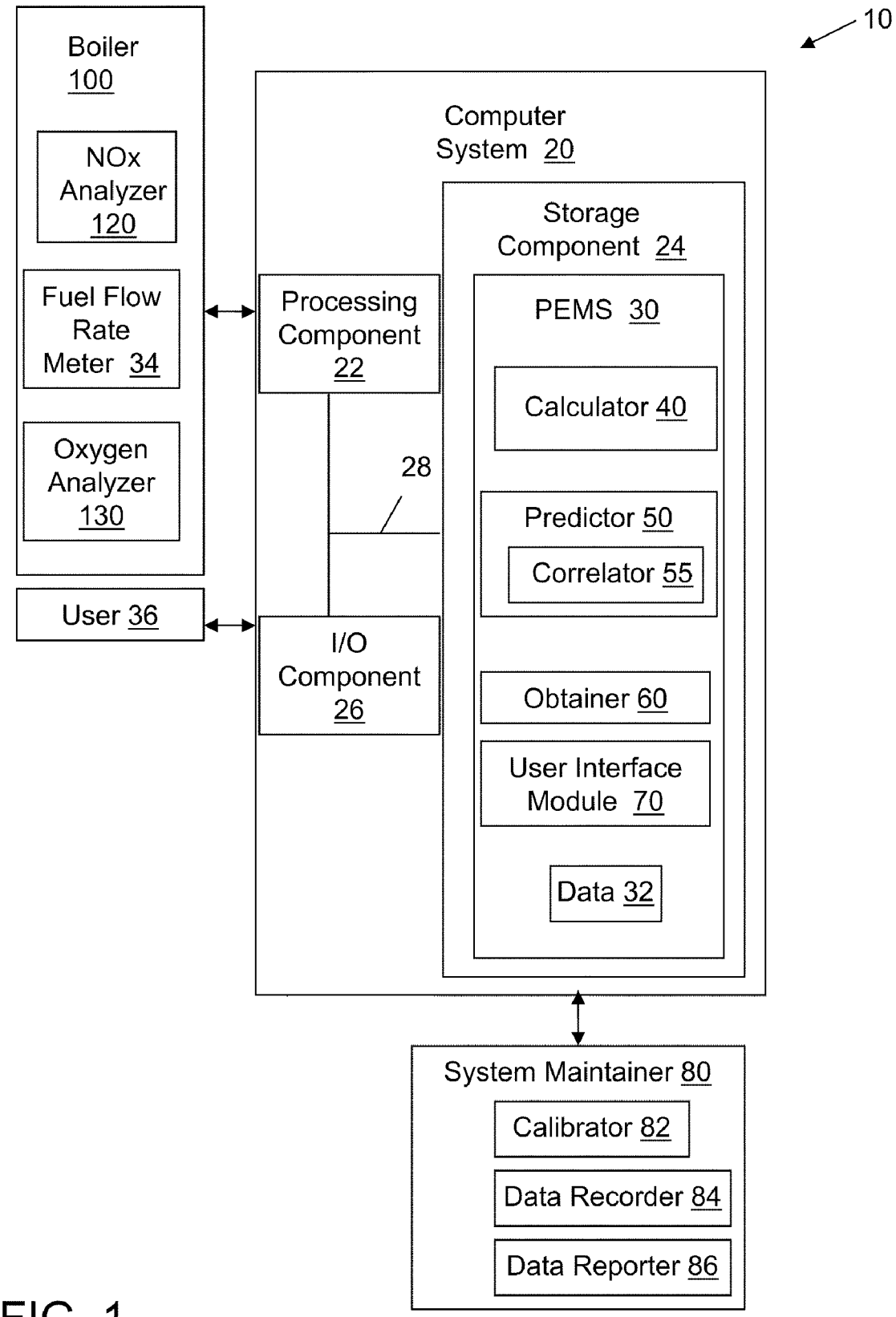
FIG. 1 shows a block diagram of an illustrative environment and for implementing a predictive monitoring system for a nitrogen oxide ($NO_x$) emission rate, in accordance with an embodiment of the present invention.

Referring to FIG. 1, an illustrated environment 10 for predicting a $NO_x$ gas emission rate from a non-continuous, natural gas-fired boiler 100 during operation is shown according to an embodiment. To this extent, environment 10 includes a computer system 20 that can carry out predicting the $NO_x$ gas emission rate. In particular, computer system 20 is shown including a predictive monitoring system (PEMS) 30 for the $NO_x$ emission rate, which makes computer system 20 operable to predict the $NO_x$ gas emission rate by performing a process described herein.

Computer system 20 is shown in communication with a natural gas-fired boiler 100. In an embodiment, boiler 100 may be a Nebraska Boiler Company (Model No. N2S-7/S-100-ECON-SH-HM) water tube boiler. Boiler 100 may be a non-continuous, natural gas-fired boiler with a rated heat input capacity of 244 MMBtu/hr. Steam from boiler 100 may be used to spin steam turbines to simulate conditions that the turbines would encounter at an electric utility plant. The steam pressure, temperature, and moisture content may be varied to simulate real-world conditions while turbine performance data is recorded and appropriate adjustments to the turbine are made.

In another embodiment, boiler 100 may be equipped with a NAT-COM Low $NO_x$ burner (Model No. P-244-LOG-41-2028) and a flue gas recirculation apparatus (FGR) for $NO_x$ emissions control. Boiler 100 flue gases may be discharged to the atmosphere, e.g., through a 60-inch inside diameter (ID) stack approximately 75 feet above grade. In another embodiment, boiler 100 may also include a natural gas fuel flow rate meter 34, a $NO_x$ analyzer 120, and an oxygen analyzer 130.

In one embodiment of fuel flow rate meter 34, natural gas fuel flow to boiler 100 may be monitored, e.g., using a coriolis type flow meter manufactured by Emerson Process Management (Micro Motion Elite Series Model No. CMF300). Emerson Micro Motion MVD Model 1700 flow transmitters may be used to convert fuel flow meter output to natural gas fuel flow in units of standard cubic feet per hour (scfh). In another embodiment of fuel flow meter 34, a multivariable flow meter may be installed on boiler 100 to serve as a back-up fuel meter, e.g., Rosemount Model 3095.

In an embodiment of $NO_x$ analyzer 120, $NO_x$ emission concentrations from boiler 100 may be monitored, e.g., using an Advanced Pollution Instruments (API) model 200AH chemi-luminescent analyzer.

In an embodiment of oxygen analyzer 130, flue gas oxygen content for boiler 100 may be continuously monitored using, e.g., a Yokogawa oxygen analyzer (Model No. ZR202G). Analyzer 130 may be a single point wet, in-situ based system, mounted directly on boiler exhaust breaching below the boiler economizer. Certified calibration gases (zero and span) may be directed from calibration cylinders located near boiler 100 to the sensor chambers via tubing. Sensor output may be sent to the electronics assembly where it is converted to a linear (4-20 mA) signal proportional to the percent oxygen in the flue gas.

Further, computer system 20 is shown in communication with a user 36 and a system maintainer 80. User 36 may, for example, be a programmer, an operator, or another computer system. Interactions between these components and computer system 20 are discussed herein.

Computer system 20 is shown including a processing component 22 (e.g., one or more processors), a storage component 24 (e.g., a storage hierarchy), an input/output (I/O) component 26 (e.g., one or more I/O interfaces and/or devices), and a communications pathway 28. In one embodiment, processing component 22 executes program code, such as PEMS 30, which is at least partially fixed in storage component 24. While executing program code, processing component 22 can process data, which can result in reading and/or writing the data to/from storage component 24 and/or I/O component 26 for further processing. Pathway 28 provides a communications link between each of the components in computer system 20. I/O component 26 can comprise one or more human I/O devices or storage devices, which enable user 36 to interact with computer system 20 and/or one or more communications devices to enable user 36 to communicate with computer system 20 using any type of communications link. To this extent, PEMS 30 can manage a set of interfaces (e.g., graphical user interface(s), application program interface, and/or the like) that enable human and/or system users 36 to interact with PEMS 30. Further, PEMS 30 can manage (e.g., store, retrieve, create, manipulate, organize, present, etc.) the data, such as PEMS data 32, using any solution.

In any event, computer system 20 can comprise one or more general purpose computing articles of manufacture (e.g., computing devices) capable of executing program code, such as PEMS 30 program code, installed thereon. As used herein, it is understood that "program code" means any collection of instructions, in any language, code or notation, that cause a computing device having an information processing capability to perform a particular function either directly or after any combination of the following: (a) conversion to another language, code or notation; (b) reproduction in a different material form; and/or (c) decompression. To this extent, PEMS 30 can be embodied as any combination of system software and/or application software.

In any event, the technical effect of computer system 20 is to provide processing instructions for monitoring and/or predicting $NO_x$ emission rates from a non-continuous, natural gas-fired boiler 100 during operation. In another embodiment of computer system 20, it may monitor, record, and track all operating parameters related to boiler 100, including oxygen concentration data, natural gas fuel flow rate data, and $NO_x$ emission concentration data. In another embodiment of computer system 20, it may monitor, record, and track all data generated by system maintainer 80, as described herein.

Further, PEMS 30 can be implemented using a set of modules such as calculator 40 and predictor 50. In this case, a module can enable computer system 20 to perform a set of tasks used by PEMS 30, and can be separately developed and/or implemented apart from other portions of PEMS 30. PEMS 30 may include modules that comprise a specific use machine/hardware and/or software. Regardless, it is understood that two or more modules, and/or systems may share some/all of their respective hardware and/or software.

As used herein, the term "component" means any configuration of hardware, with or without software, which implements the functionality described in conjunction therewith using any solution, while the term "module" means program code that enables a computer system 20 to implement the functionality described in conjunction therewith using any solution. When fixed in a storage component 24 of a computer system 20 that includes a processing component 22, a module is a substantial portion of a component that implements the functionality. Regardless, it is understood that two or more components, modules, and/or systems may share some/all of their respective hardware and/or software. Further, it is understood that some of the functionality discussed herein may not be implemented or additional functionality may be included as part of computer system 20.

When computer system 20 comprises multiple computing devices, each computing device may have only a portion of PEMS 30 embodied thereon (e.g., one or more modules). However, it is understood that computer system 20 and PEMS 30 are only representative of various possible equivalent computer systems that may perform a process described herein. To this extent, in other embodiments, the functionality provided by computer system 20 and PEMS 30 can be at least partially implemented by one or more computing devices that include any combination of general and/or specific purpose hardware with or without program code. In each embodiment, the hardware and program code, if included, can be created using standard engineering and programming techniques, respectively.

Regardless, when computer system 20 includes multiple computing devices, the computing devices can communicate over any type of communications link. Further, while performing a method described herein, computer system 20 can communicate with one or more other computer systems using any type of communications link. In either case, the communications link can comprise any combination of various types of wired and/or wireless links; comprise any combination of one or more types of networks; and/or utilize any combination of various types of transmission techniques and protocols.

PEMS 30 enables computer system 20 to provide processing instructions for monitoring and/or predicting $NO_x$ emission rates of boiler 100. PEMS 30 may include logic, which may include the following functions: a calculator 40, a predictor 50, an obtainer 60, and a user interface module 70. Predictor 50 may additionally comprise a correlator 55. Structurally, the logic may take any of a variety of forms such as a module, a field programmable gate array (FPGA), a microprocessor, a digital signal processor, an application specific integrated circuit (ASIC) or any other specific use machine structure capable of carrying out the functions described herein. Logic may take any of a variety of forms, such as software and/or hardware. However, for illustrative purposes, PEMS 30 and logic included therein will be described herein as a specific use machine. As will be understood from the description, while logic is illustrated as including each of the above-stated functions, not all of the functions are necessary according to the teachings of the invention as recited in the appended claims.

Obtainer 60 obtains data such as measured fuel flow rates, sampled flue gas oxygen concentrations, and sampled $NO_x$ concentrations of boiler 100. In an embodiment of obtainer 60, it may obtain a plurality of fuel flow rates from fuel flow rate meter 34, and corresponding samples of oxygen concentrations from oxygen analyzer 130 and samples of $NO_x$ concentrations from $NO_x$ analyzer 120 of the non-continuous, natural gas-fired boiler 100 at different points in time during operation. In another embodiment, obtainer 60 may obtain a single measured fuel flow rate, a single sampled flue gas oxygen concentration, and a single sampled $NO_x$ concentration corresponding to the same point in time. In one embodiment, obtainer 60 may perform both functions.

In another embodiment, three obtainers 60 may be used; one for fuel flow rate data acquisition, one for flue gas oxygen concentration data acquisition, and another for $NO_x$ concentration data acquisition. Obtainer 60 may be in communication with boiler 100 and in particular, natural gas fuel flow meter 34, oxygen analyzer 130, and $NO_x$ analyzer 120 to obtain the respective data. In another embodiment, obtainer 60 may be in communication with calculator 40 and/or predictor 50 as described herein.

Alternatively, user 36 may provide data obtained from natural gas fuel flow rate meter 34, oxygen analyzer 130, and $NO_x$ analyzer to computer system 20 via I/O component 26. In another embodiment, obtainer 60 may obtain data such as natural gas fuel firing rate, steam flow rate, steam pressure and temperature, and flue gas regulator setting. One having ordinary skill in the art would recognize the meters, sensors, etc. that may be used to provide the aforementioned data and thus, for the sake of clarity, no further discussion is provided. Natural gas fuel flow rate meter 34, oxygen analyzer 130, and $NO_x$ analyzer 120 may be linked to computer system 20 in any conventional manner, and may provide data about fuel flow rate, oxygen concentration, and $NO_x$ concentration in any conventional manner.

Calculator 40 calculates a correlation of a $NO_x$ emission rate to the measured fuel flow rate and the sampled $O_2$ concentration based on a plurality of sampled $NO_x$ emission concentrations, measured fuel flow rates, and sampled $O_2$ concentrations during operation of the non-continuous, natural gas-fired boiler. In one embodiment, calculator 40 may receive the plurality of sampled $NO_x$ emission concentrations, measured fuel flow rates, and sampled $O_2$ concentrations from obtainer 40. In another embodiment, calculator 40 may receive the plurality of sampled $NO_x$ emission concentrations, measured fuel flow rates, and sampled $O_2$ concentrations from user 36.

Predictor 50 predicts the $NO_x$ emission rate based on the correlation with the measured fuel flow rate and the sampled $O_2$ concentration, and alternatively, using a method for predicting $NO_x$ emission rate of a non-continuous, natural gas-fired boiler as described herein. In one embodiment, predictor 50 may predict the $NO_x$ emission rate by: obtaining a fuel flow rate and a corresponding $O_2$ concentration of the non-continuous, natural gas-fired boiler during operation; correlating the obtained fuel flow rate and corresponding obtained $O_2$ concentration with the correlation, via a correlator 55, to arrive at the measured fuel flow rate and the sampled $O_2$ concentration; and predicting the $NO_x$ emission rate based on the correlation with the measured fuel flow rate and sampled $O_2$ concentration.

In an embodiment, predictor 50 comprises a correlator 55. Correlator 55 correlates the obtained fuel flow rate and corresponding obtained $O_2$ concentration with the correlation to arrive at the measured fuel flow rate and the corresponding sampled $O_2$ concentration.

PEMS 30 can provide the predicted $NO_x$ emission rate for use by user 36, for example, via a user interface module 70. In an embodiment, user interface module 70 provides a graphical user interface. It is understood, however, that it may be embodied in many different forms, e.g., a numerical representation without graphics data suitable for processing by another system, etc. In one embodiment, user 36 may provide data about a fuel flow rate, flue gas oxygen, and/or $NO_x$ emission concentration of boiler 100 by providing data to user interface module 70. In another embodiment, user 36 may provide data representing correlations, as described for boiler 100.

While shown and described herein as a $NO_x$ emission predictive monitoring system, it is understood that aspects of the invention further provide various alternative embodiments. For example, in one embodiment, the invention provides a computer program embodied in at least one computer-readable medium, which when executed, enables a computer system to predict the $NO_x$ emission rate of a boiler. To this extent, the computer-readable medium includes program code, such as PEMS 30, which implements some or all of a process described herein. It is understood that the term "computer-readable medium" comprises one or more of any type of tangible medium of expression capable of embodying a copy of the program code (e.g., a physical embodiment). For example, the computer-readable medium can comprise: one or more portable storage articles of manufacture; one or more memory/storage components of a computing device; paper; and/or the like.

In another embodiment, the invention provides a method of providing a copy of program code, such as PEMS 30, which implements some or all of a process described herein. In this case, a computer system can generate and transmit, for reception at a second, distinct location, a set of data signals that has one or more of its characteristics set and/or changed in such a manner as to encode a copy of the program code in the set of data signals. Similarly, an embodiment of the invention provides a method of acquiring a copy of program code that implements some or all of a process described herein, which includes a computer system receiving the set of data signals described herein, and translating the set of data signals into a copy of the computer program embodied in at least one computer-readable medium. In either case, the set of data signals can be transmitted/received using any type of communications link.

Further, system maintainer 80 is shown in communication with computer system 20. System maintainer 80 comprises a calibrator 82, a data recorder 84, and a data reporter 86. Calibrator 82 calibrates computer system 20 and/or boiler 100, described herein. Data recorder 84 records data about computer system 20 and/or boiler 100, described herein. Data reporter 86 reports data about computer system 20 and/or boiler 100, described herein. In one embodiment, system maintainer 80 may be in direct communication with boiler 100. In another embodiment, system maintainer 80 may be in direct communication with user 36.

In still another embodiment, the invention provides a method of generating a system for predicting the $NO_x$ emission rate of boiler 100 during operation. In this case, a computer system, such as computer system 20, can be obtained (e.g., created, maintained, made available, etc.) and one or more components for performing a process described herein can be obtained (e.g., created, purchased, used, modified, etc.) and deployed to the computer system. To this extent, the deployment can comprise one or more of: (1) installing program code on a computing device from a computer-readable medium; (2) adding one or more computing and/or I/O devices to the computer system; and (3) incorporating and/or modifying the computer system to enable it to perform a process described herein.

Figure 2:
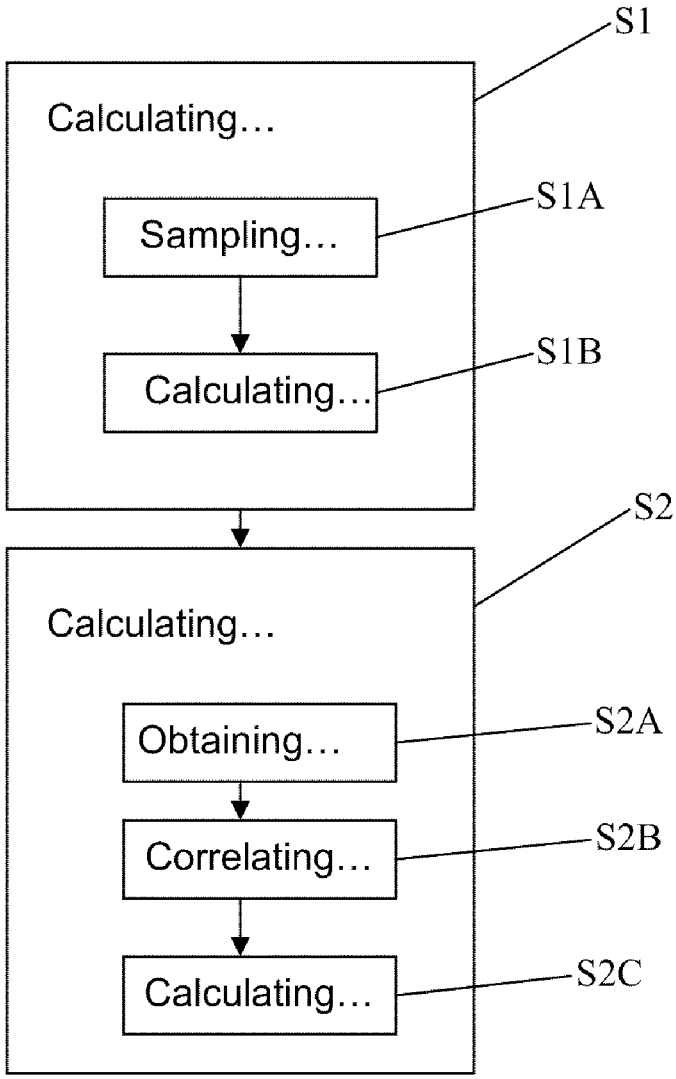
FIG. 2 shows a flow diagram of a method for predicting a $NO_x$ emission rate of a non-continuous, natural gas-fired boiler, in accordance with an embodiment of the present invention.

Referring to FIG. 2, an embodiment of a method for predicting a nitrogen oxide ($NO_x$) emission rate of a non-continuous, natural gas-fired boiler is shown. Step S1 includes calculating a correlation of the $NO_x$ emission rate to a measured fuel flow rate, and a sampled oxygen concentration based on a plurality of sampled $NO_x$ emission concentrations, measured fuel flow rates, and sampled oxygen ($O_2$) concentrations during operation of the non-continuous, natural gas-fired boiler. In an embodiment, step S1 may be performed by calculator 40 of PEMS 30, see FIG. 1. Step S2 includes calculating a predicted $NO_x$ emission rate based on the correlation with the measured fuel flow rate and the sampled $O_2$ concentration. In an embodiment, step S2 may be performed by predictor 50 of PEMS 30, see FIG. 1.

In an embodiment of step S1 of FIG. 2, calculating the correlation comprises a step S1A, periodically sampling flue gas from the non-continuous, natural gas-fired boiler during operation at the plurality of measured fuel flow rates to obtain the plurality of corresponding sampled $O_2$ concentrations and sampled $NO_x$ concentrations. In an embodiment, step S1A may be performed by fuel flow rate meter 34, $NO_x$ analyzer 120, and oxygen analyzer 130 of boiler 100, see FIG. 1.

In an embodiment of step S1A, sampling flue gas may be conducted on two boilers, having the characteristics of boiler 100, see FIG. 1, to calculate the correlation of the $NO_x$ emission rate to boiler operating load (represented by measured fuel flow rate) and flue gas oxygen concentration. Hereon in and unless otherwise stated, reference to boiler 100 will mean two boilers, i.e., boiler 1 and boiler 2. In an embodiment, the boiler operating load is meant as the "degree of staged combustion" as recited in United States 40 Code of Federal Regulation (C.F.R.) §60.49b(c)(1) and boiler 100 exhaust $O_2$ concentration as the "level of excess air."

In an embodiment, natural gas fuel firing rate and boiler 100 exhaust oxygen concentration may be monitored and recorded approximately every five minutes during correlation testing. The standard fuel F-factor for natural gas (8,710 dscf/MMBtu) outlined in Table 19.2 of United States Environmental Protection Agency (U.S.E.P.A.) Reference Method (RM) 19 may be used to normalize $NO_x$ concentrations to heat input (lb/MMBtu). The foregoing data may be acquired by $NO_x$ analyzer 120, fuel flow rate meter 34, and oxygen analyzer 130, see FIG. 1. In another embodiment, steam flow rate, steam pressure and temperature, and flue gas regulation settings may be monitored.

Flue gas may be sampled at test ports in the 60-inch ID boiler exhaust stacks located approximately 27 feet (5.4 diameters) downstream of the FGR breeching and approximately 6 feet (1.2 diameters) upstream of boiler 100 stack exhaust. There may be four test ports located 90° apart in the same plane. A $NO_x$ stratification check may be conducted prior to the start of testing in accordance with U.S.E.P.A. RM 7E requirements. Sampled $NO_x$ concentrations may be determined based on the results of this check.

Six boiler operating load points may be selected and sampling corresponding to the six boiler operating load points may be done in triplicate. At each load point, three $O_2$ concentrations may be sampled (total of 54 test runs per boiler). Corresponding natural gas fuel flow rates for the six set load points may be selected based on natural gas heat content. In a embodiment, the natural gas heat content may be 1,020 BTU/$ft^3$. The six boiler load points tested may be a percentage of the rated boiler heat input.

Sampled $NO_x$ emission concentration analysis may be conducted using U.S.E.P.A. RMs described in 40 C.F.R. §60, Appendix A. RM 3A: gas analysis for the determination of dry molecular weight and Method 7E: determination of nitrogen oxide emissions from stationary sources—Instrumental analyzer procedure—were used for the analysis. In an embodiment, the aforementioned methods may be conducted in triplicate. The test durations may be approximately 21 minutes.

Boiler 100 exhaust concentrations of oxygen may be determined in accordance with U.S.E.P.A. RM 3A (instrumental method). A continuous gas sample may be extracted from the emission source at a single point through a sintered filter, heated probe, and heated polytetrafluoroethylene (Teflon®) sample line and a gas conditioner may be used to remove moisture from the gas stream. All material that may come in contact with the sample may be constructed of stainless steel, glass, or Teflon®. In an embodiment, data from oxygen analyzer 134 may be obtained by obtainer 40 and recorded every two seconds on storage component 24 of computer system 20, see FIG. 1. In another embodiment, data from oxygen analyzer 134 may be continuously obtained by obtainer 40 and recorded on storage component 24 of computer system 20, see FIG. 1. In an embodiment, emissions data may be reported as 5-minute averages for each test run.

In an embodiment, sampled $NO_x$ emission concentration may be analyzed in accordance with U.S.E.P.A. RM 7E. The same sample collection, conditioning system, and Continuous Monitoring Emission System (CEMS) used for RM 3A sampling may be used for the RM 7E sampling.

Oxygen concentration data, $NO_x$ concentration data, and fuel flow rate data, may be embodied on a machine readable medium. For example, the medium may be a CD, a compact flash, other flash memory, a packet of data to be sent via the Internet, or other networking suitable means. Additionally the machine readable medium can comprise: one or more portable storage articles of manufacture; one or more memory/storage components of a computing device; paper; and/or the like. Tables 1 and 2 list the plurality of sampled oxygen concentrations, sampled $NO_x$ concentrations, and measured fuel flow rate data that was sampled for boilers 1 and 2 respectively in an embodiment of method step S1A of method step S1, see FIG. 2.

TABLE 1

Summary of Flue Gas Analysis for Boiler 1

| Operating Load (%) | Oxygen Level | Run ID | Oxygen (%) | $NO_x$ (ppm) | NOx[b] (lb NOx/MMBtu) |
|---|---|---|---|---|---|
| 90 | High | 1 | 4.10 | 31.6 | 0.041 |
| 90 | High | 2 | 4.12 | 32.0 | 0.041 |
| 90 | High | 3 | 4.14 | 31.8 | 0.041 |
| | | Average | 4.12 | 31.8 | 0.041 |
| 90 | Normal | 1 | 3.05 | 33.5 | 0.041 |
| 90 | Normal | 2 | 3.06 | 33.6 | 0.041 |
| 90 | Normal | 3 | 3.06 | 33.6 | 0.041 |
| | | Average | 3.06 | 33.6 | 0.041 |
| 90 | Low | 1 | 2.47 | 34.0 | 0.040 |
| 90 | Low | 2 | 2.47 | 34.1 | 0.040 |
| 90 | Low | 3 | 2.47 | 34.2 | 0.040 |
| | | Average | 2.47 | 34.1 | 0.040 |
| 70 | High | 1 | 4.21 | 28.8 | 0.038 |
| 70 | High | 2 | 4.23 | 28.7 | 0.037 |
| 70 | High | 3 | 4.23 | 28.7 | 0.037 |
| | | Average | 4.22 | 28.7 | 0.037 |
| 70 | Normal | 1 | 3.12 | 29.6 | 0.036 |
| 70 | Normal | 2 | 3.11 | 30.2 | 0.037 |
| 70 | Normal | 3 | 3.11 | 30.3 | 0.037 |
| | | Average | 3.11 | 30.0 | 0.037 |
| 70 | Low | 1 | 2.34 | 30.0 | 0.035 |
| 70 | Low | 2 | 2.35 | 29.85 | 0.035 |
| 70 | Low | 3 | 2.38 | 29.66 | 0.035 |
| | | Average | 2.36 | 29.8 | 0.035 |
| 50 | High | 1 | 4.21 | 24.68 | 0.032 |
| 50 | High | 2 | 4.20 | 24.65 | 0.032 |
| 50 | High | 3 | 4.22 | 24.70 | 0.032 |
| | | Average | 4.21 | 24.7 | 0.032 |
| 50 | Normal | 1 | 3.02 | 27.01 | 0.033 |
| 50 | Normal | 2 | 3.08 | 27.37 | 0.033 |
| 50 | Normal | 3 | 3.02 | 26.88 | 0.033 |
| | | Average | 3.04 | 27.1 | 0.033 |
| 50 | Low | 1 | 2.51 | 26.23 | 0.031 |
| 50 | Low | 2 | 2.46 | 25.96 | 0.031 |
| 50 | Low | 3 | 2.46 | 25.84 | 0.030 |
| | | Average | 2.48 | 26.0 | 0.031 |
| 30 | High | 1 | 6.53 | 23.51 | 0.036 |
| 30 | High | 2 | 6.60 | 23.57 | 0.036 |
| 30 | High | 3 | 6.60 | 23.58 | 0.036 |
| | | Average | 6.58 | 23.6 | 0.036 |
| 30 | Normal | 1 | 4.46 | 27.36 | 0.036 |
| 30 | Normal | 2 | 4.40 | 27.44 | 0.036 |
| 30 | Normal | 3 | 4.40 | 26.25 | 0.035 |
| | | Average | 4.42 | 27.0 | 0.036 |
| 30 | Low | 1 | 2.73 | 27.85 | 0.033 |
| 30 | Low | 2 | 2.72 | 27.83 | 0.033 |
| 30 | Low | 3 | 2.74 | 27.84 | 0.033 |
| | | Average | 2.73 | 27.8 | 0.033 |
| 10 | High | 1 | 10.96 | 20.88 | 0.046 |
| 10 | High | 2 | 10.96 | 21.29 | 0.047 |
| 10 | High | 3 | 10.97 | 21.59 | 0.047 |
| | | Average | 10.96 | 21.3 | 0.046 |
| 10 | Normal | 1 | 6.71 | 25.46 | 0.039 |
| 10 | Normal | 2 | 6.68 | 24.29 | 0.037 |
| 10 | Normal | 3 | 6.69 | 24.32 | 0.037 |
| | | Average | 6.69 | 24.7 | 0.038 |
| 10 | Low | 1 | 4.84 | 24.06 | 0.033 |
| 10 | Low | 2 | 4.87 | 24.33 | 0.033 |
| 10 | Low | 3 | 4.85 | 23.97 | 0.032 |
| | | Average | 4.85 | 24.1 | 0.033 |
| 3.2 | High | 1 | 17.86 | 7.99 | 0.057 |
| 3.2 | High | 2 | 17.96 | 7.78 | 0.058 |
| 3.2 | High | 3 | 17.96 | 7.78 | 0.058 |
| | | Average | 17.93 | 7.9 | 0.057 |
| 3.2 | Normal | 1 | 15.59 | 11.19 | 0.046 |
| 3.2 | Normal | 2 | 15.58 | 11.32 | 0.046 |
| 3.2 | Normal | 3 | 15.52 | 11.33 | 0.046 |
| | | Average | 15.56 | 11.3 | 0.046 |
| 3.2 | Low | 1 | 14.12 | 15.11 | 0.048 |
| 3.2 | Low | 2 | 14.41 | 14.23 | 0.048 |
| 3.2 | Low | 3 | 14.33 | 14.59 | 0.048 |
| | | Average | 14.29 | 14.6 | 0.048 |

[b]Calculated $NO_x$ emission rate—see explanation infra

TABLE 2

Summary of Flue Gas Analysis for Boiler 2

| Operating Load (%) | Oxygen Level | Run ID | Oxygen (%) | $NO_x$ (ppm) | Nox[b] (lbNOx/MMBtu) |
|---|---|---|---|---|---|
| 90 | High | 1 | 3.87 | 30.5 | 0.039 |
| 90 | High | 2 | 3.84 | 30.9 | 0.039 |
| 90 | High | 3 | 3.79 | 30.9 | 0.039 |
| | | Average | 3.83 | 30.8 | 0.039 |
| 90 | Normal | 1 | 2.84 | 33.8 | 0.041 |
| 90 | Normal | 2 | 2.84 | 33.7 | 0.041 |
| 90 | Normal | 3 | 2.84 | 34.2 | 0.041 |
| | | Average | 2.84 | 33.9 | 0.041 |
| 90 | Low | 1 | 2.15 | 34.9 | 0.040 |
| 90 | Low | 2 | 2.12 | 34.7 | 0.040 |
| 90 | Low | 3 | 2.07 | 35.3 | 0.041 |
| | | Average | 2.11 | 35.0 | 0.040 |
| 70 | High | 1 | 4.47 | 26.76 | 0.035 |
| 70 | High | 2 | 4.47 | 26.34 | 0.035 |
| 70 | High | 3 | 4.47 | 26.47 | 0.035 |
| | | Average | 4.47 | 26.5 | 0.035 |
| 70 | Normal | 1 | 3.28 | 29.5 | 0.036 |
| 70 | Normal | 2 | 3.32 | 29.6 | 0.037 |
| 70 | Normal | 3 | 3.32 | 29.5 | 0.037 |
| | | Average | 3.31 | 29.5 | 0.036 |
| 70 | Low | 1 | 2.44 | 30.8 | 0.036 |
| 70 | Low | 2 | 2.43 | 30.8 | 0.036 |
| 70 | Low | 3 | 2.42 | 31.0 | 0.036 |
| | | Average | 2.43 | 30.8 | 0.036 |
| 50 | High | 1 | 5.48 | 23.57 | 0.033 |
| 50 | High | 2 | 5.47 | 23.57 | 0.033 |
| 50 | High | 3 | 5.46 | 23.62 | 0.033 |
| | | Average | 5.47 | 23.6 | 0.033 |
| 50 | Normal | 1 | 4.51 | 26.28 | 0.035 |
| 50 | Normal | 2 | 4.49 | 26.08 | 0.035 |
| 50 | Normal | 3 | 4.47 | 26.04 | 0.034 |
| | | Average | 4.49 | 26.1 | 0.035 |
| 50 | Low | 1 | 3.33 | 27.66 | 0.034 |
| 50 | Low | 2 | 3.33 | 27.71 | 0.034 |
| 50 | Low | 3 | 3.33 | 27.70 | 0.034 |
| | | Average | 3.33 | 27.7 | 0.034 |
| 30 | High | 1 | 5.79 | 27.66 | 0.040 |
| 30 | High | 2 | 5.77 | 27.83 | 0.040 |
| 30 | High | 3 | 5.76 | 27.70 | 0.040 |
| | | Average | 5.77 | 27.7 | 0.040 |
| 30 | Normal | 1 | 4.92 | 27.79 | 0.038 |
| 30 | Normal | 2 | 4.88 | 27.54 | 0.037 |
| 30 | Normal | 3 | 4.83 | 28.22 | 0.038 |
| | | Average | 4.88 | 27.9 | 0.038 |
| 30 | Low | 1 | 3.64 | 29.23 | 0.037 |
| 30 | Low | 2 | 3.63 | 29.28 | 0.037 |
| 30 | Low | 3 | 3.62 | 29.78 | 0.037 |
| | | Average | 3.63 | 29.4 | 0.037 |
| 10 | High | 1 | 10.54 | 23.09 | 0.048 |
| 10 | High | 2 | 10.54 | 23.53 | 0.049 |
| 10 | High | 3 | 10.51 | 23.68 | 0.050 |
| | | Average | 10.53 | 23.4 | 0.049 |
| 10 | Normal | 1 | 7.31 | 23.21 | 0.037 |
| 10 | Normal | 2 | 7.24 | 22.66 | 0.036 |
| 10 | Normal | 3 | 7.17 | 22.40 | 0.035 |
| | | Average | 7.24 | 22.8 | 0.036 |
| 10 | Low | 1 | 4.68 | 23.11 | 0.031 |
| 10 | Low | 2 | 4.65 | 22.32 | 0.030 |
| 10 | Low | 3 | 4.68 | 22.24 | 0.030 |
| | | Average | 4.67 | 22.6 | 0.030 |
| 3.2 | High | 1 | 17.65 | 8.35 | 0.056 |
| 3.2 | High | 2 | 17.65 | 8.30 | 0.056 |
| 3.2 | High | 3 | 17.63 | 8.41 | 0.056 |
| | | Average | 17.64 | 8.4 | 0.056 |
| 3.2 | Normal | 1 | 16.12 | 10.47 | 0.048 |
| 3.2 | Normal | 2 | 16.11 | 10.69 | 0.049 |
| 3.2 | Normal | 3 | 16.10 | 10.73 | 0.049 |
| | | Average | 16.11 | 10.6 | 0.048 |
| 3.2 | Low | 1 | 14.77 | 14.22 | 0.050 |
| 3.2 | Low | 2 | 14.74 | 14.41 | 0.051 |
| 3.2 | Low | 3 | 14.74 | 14.31 | 0.050 |
| | | Average | 14.75 | 14.3 | 0.051 |

[b]Calculated $NO_x$ emission rate—see explanation infra

Referring to FIG. 2, in an embodiment of method step S1, step S1 also comprises a step S1B, calculating the correlation of the $NO_x$ emission rate based on the plurality of measured fuel flow rates, and corresponding sampled $NO_x$ emission concentrations and sampled $O_2$ concentrations. In an embodiment, step S1B may be performed by calculator 40 of PEMS 30, see FIG. 1.

Calculator 40, see FIG. 1, may calculate $NO_x$ emission rates in lb/MMBtu using the sampled $NO_x$ concentration ($NO_x$), sampled $O_2$ concentration ($O_2$), and fuel flow rate data from Tables 1 and 2, and Formula 1.

$$NO_x \text{ emission rate (lb } NO_x\text{/MMBtu)} = NO_x \text{ (ppm)} \times \text{F-factor} \times A \times /20.91(20.9 - O_2\%)] \quad (1)$$

A=1.194E-07 for $NO_x$

F-factor=8,710 dscf Btu for natural gas

Figure 3:
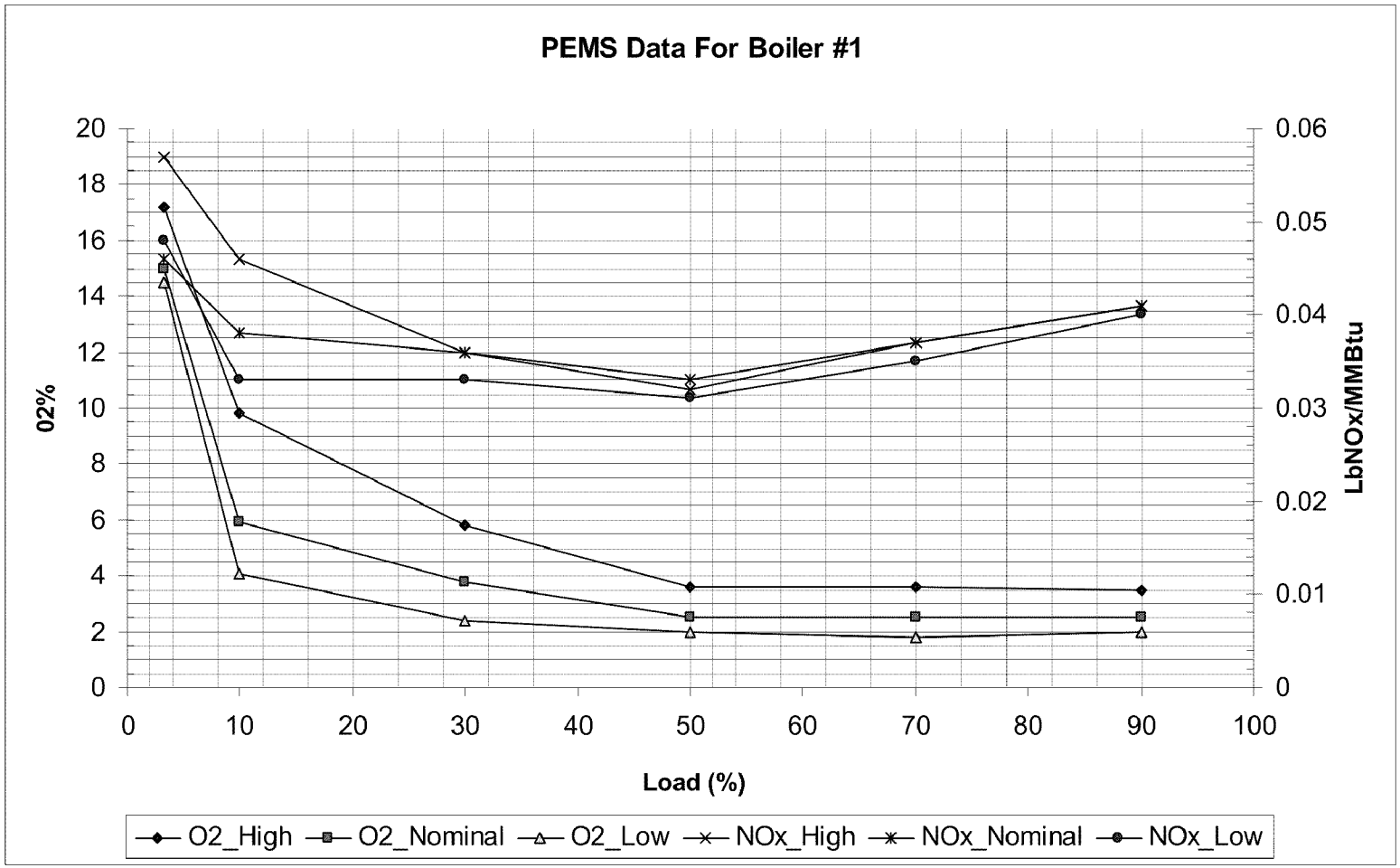
FIG. 3 shows a $NO_x$ correlation curve in a method for calculating a correlation for a $NO_x$ emission rate, in accordance with an embodiment of the present invention.
Figure 4:
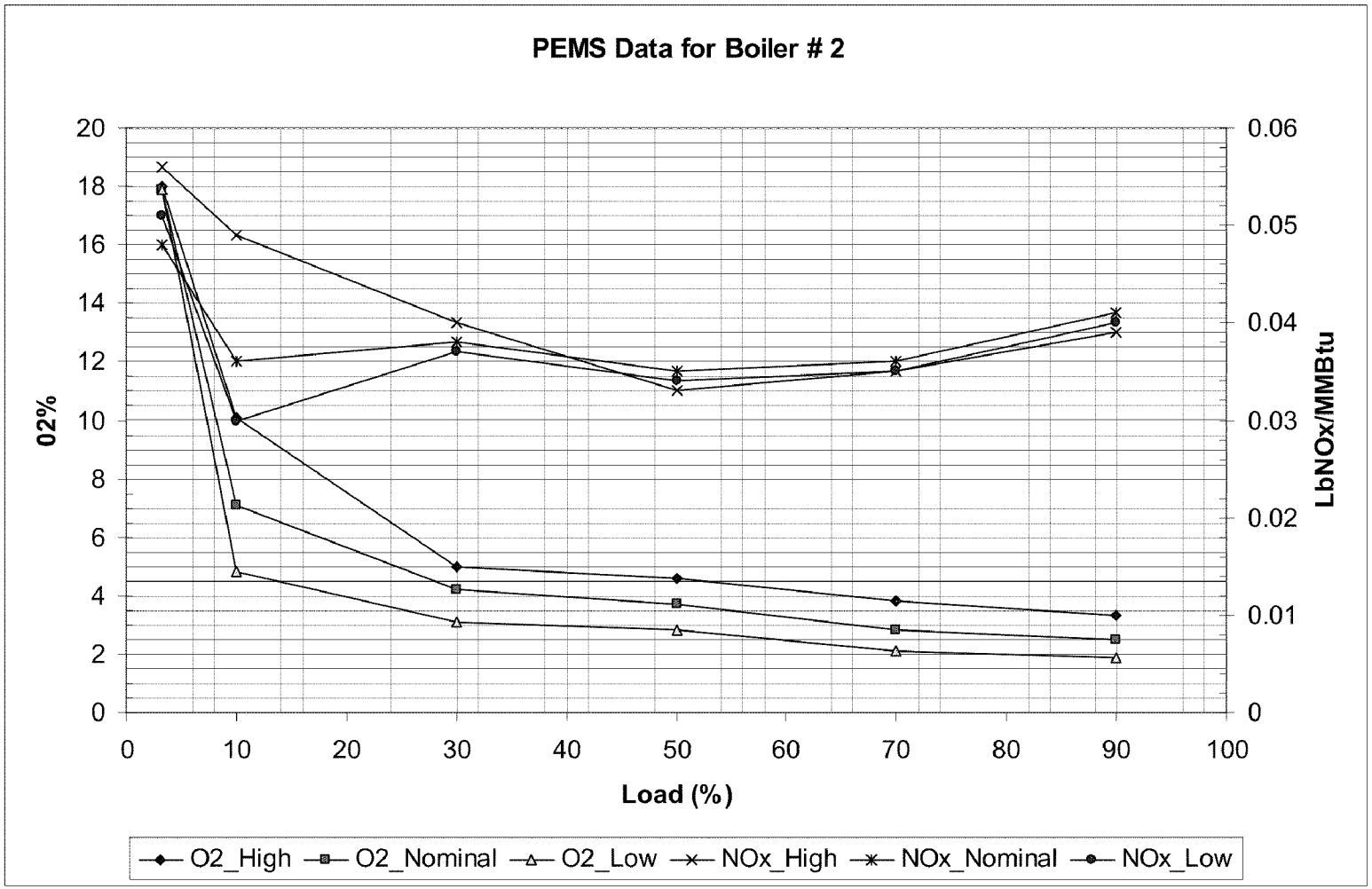
FIG. 4 shows a $NO_x$ correlation curve in a method for calculating a correlation for $NO_x$ emission rate, in accordance with another embodiment of the present invention.

Calculated $NO_x$ emission rates are listed in Tables 1 and 2. The correlation may be calculated by plotting the calculated $NO_x$ emission rates against the sampled $O_2$ concentration and measured fuel flow rates. In an embodiment of the correlation, FIG. 3 and FIG. 4 show curves that represent the correlation of the $NO_x$ emission rate based on the plurality of sampled $NO_x$ emission concentrations, sampled oxygen concentrations, and measured fuel flow rates for boilers 1 and 2 respectively. In an embodiment, calculator 40 of PEMS 30, see FIG. 1, may calculate the foregoing correlations.

One having ordinary skill in the art may, without undue experimentation, apply the foregoing methodology of calculating a correlation for use in predicting a $NO_x$ emission rate for other non-continuous, natural gas-fired boilers that are low-$NO_x$ burners and have flue gas recirculation. Other non-continuous, natural gas-fired boilers with low-$NO_x$ burners and flue gas recirculation may have almost identical lb-$NO_x$/MMBtu emissions at the same load points and oxygen value though there may be some minor variance in actual values. For the sake of clarity, no further discussion is provided.

In an embodiment of method step S2 of FIG. 2, calculating a predicted $NO_x$ emission rate based on the correlation with the measured fuel flow rate and the sampled $O_2$ concentration, step S2 comprises a step S2A, obtaining a fuel flow rate and a corresponding $O_2$ concentration of the non-continuous, natural gas-fired boiler during operation. In an embodiment, step S2A may be performed by obtainer 60 of PEMS 30, see FIG. 1.

Referring to step S2A, obtainer 60 obtains a measured fuel flow rate for boiler 100 during operation via fuel flow rate meter 34, see FIG. 1. In an embodiment, fuel flow rate data may be obtained continuously by obtainer 60, i.e., obtained during the entire operation of boiler 100. In another embodiment, fuel flow rate data may be obtained non-continuously by obtainer 60, i.e., during intermittent points in time during operation of boiler 100. Obtainer 60 also obtains the sampled oxygen concentration of the flue exhaust gas corresponding to the measured fuel flow rate via oxygen analyzer 130. In an embodiment, the output of oxygen analyzer 130 may be in units of percent oxygen (wet basis) and continuously obtained by obtainer 60. In another embodiment, sampled oxygen concentration may be obtained non-continuously by obtainer 60.

In an embodiment, method step S2 of FIG. 2 additionally comprises a step S2B, correlating the obtained fuel flow rate and corresponding obtained $O_2$ concentration with the correlation to arrive at the measured fuel flow rate and the sampled $O_2$ concentration. In an embodiment, step S2B may be performed by correlator 55 of predictor 50, see FIG. 1.

In an embodiment of step S2B, the obtained fuel flow rate may be correlated by applying the obtained fuel flow rate from step S2A to the correlation curve, see FIG. 3 and FIG. 4, and selecting the measured fuel flow rate point from the correlation curve that is closest to the obtained fuel flow rate. The foregoing may be performed by calculator 40 of PEMS 30, FIG. 1. Calculator 40 then may convert the obtained fuel flow rate to the selected measured fuel flow rate, e.g., to arrive at the measured fuel flow rate. The sampled flue gas $O_2$ concentration may also be similarly applied to the correlation curve, see FIG. 3 and FIG. 4, and then selecting the nearest sampled $O_2$ concentration point from the correlation curve that is closest to the obtained $O_2$ concentration. Calculator 40 then may convert the obtained $O_2$ concentration to the selected sampled $O_2$ concentration, e.g., to arrive at the sampled $O_2$ concentration. Obtained fuel flow rate data below the 3 percent point of the correlation or above the 90 percent load may default to the minimum and maximum measured fuel flow rate, as applicable. Similarly, any obtained oxygen concentrations that fall below or above a sampled $O_2$ concentration on the correlation curve may default to the nearest sampled $O_2$ concentration point on the correlation curve.

In an embodiment, method step S2 of FIG. 2 additionally comprises a step S2C, calculating the predicted the $NO_x$ emission rate based on the correlation of the measured fuel flow rate and the corresponding sampled $O_2$ concentration. In an embodiment, step S2C may be performed by correlator 55 of predictor 50, see FIG. 1.

In an embodiment of step S2C, the $NO_x$ emission rate may be predicted by selecting the calculated $NO_x$ emission rate from the correlation curve corresponding to the measured fuel rate and the sampled $O_2$ concentration arrived at from the correlating step, S2B. In an embodiment of method step 2 of FIG. 2, steps S2A to S2C may be repeated, e.g., a minimum of once per minute, during operation of boiler 100.

The predicted $NO_x$ emission rate may be reported via user interface module 70. The predicted $NO_x$ emission rate may be reported as often as steps S2A-S2C are performed. In an embodiment, the aforementioned data cycle and reporting frequency may exceed 40 C.F.R. §60.13(h)(2) C.E.M.S. data reporting criteria. In an embodiment, any data considered "invalid" may not be included in emissions reported by the foregoing method for predicting the $NO_x$ emission rate of a non-continuous, natural gas-fired boiler. Invalid data may arise from periods when the $O_2$ analyzer 130 is not performing within operational parameters, or when $O_2$ analyzer data or fuel flow meter data are not available due to malfunctions. In an embodiment, the foregoing method may predict $NO_x$ emission rate data for a minimum of 75 percent of the operating hours in a boiler-operating day and in at least 22 out of 30 successive boiler operating days per 40 C.F.R. §60.48b(f).

Figure 5:
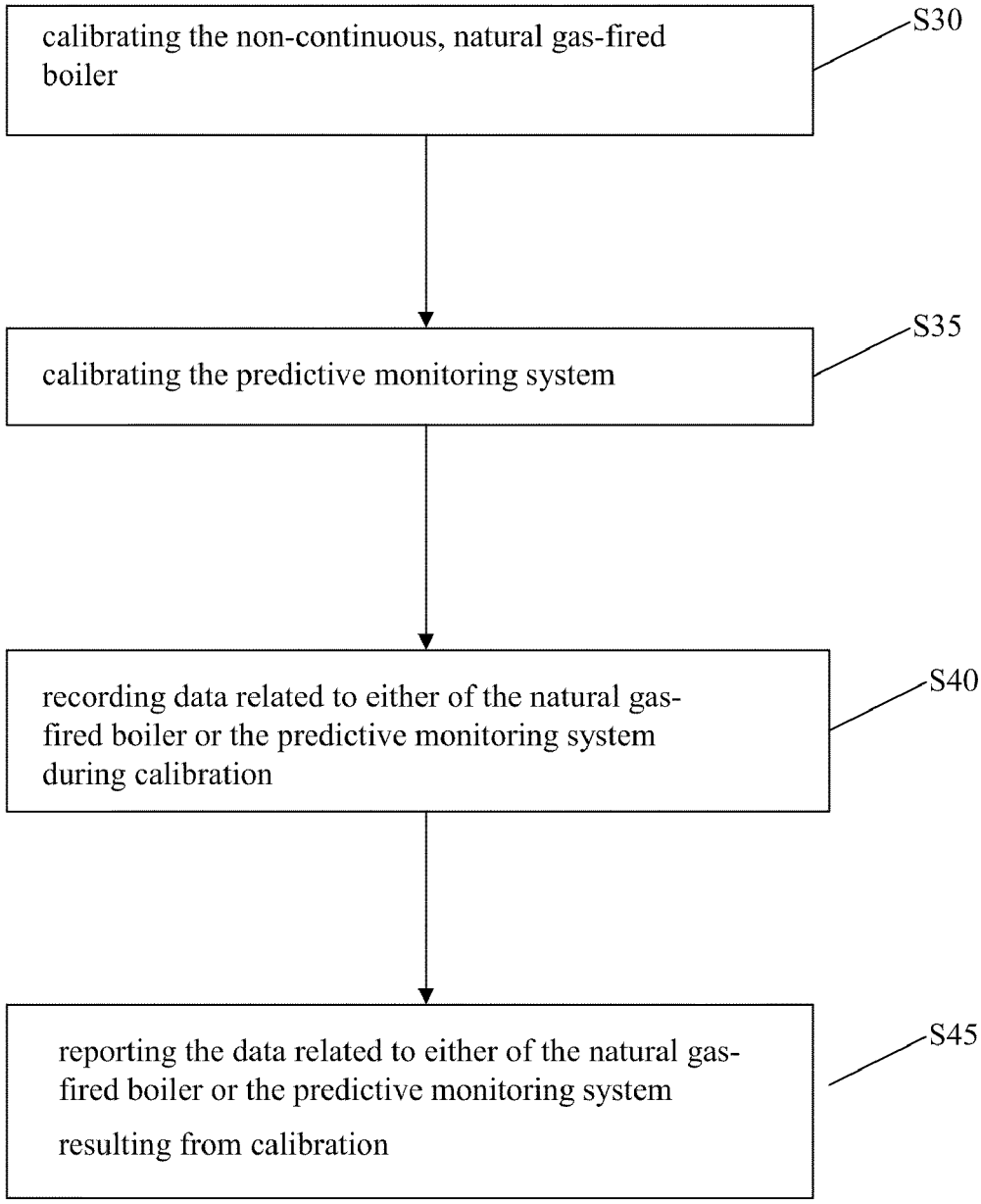
FIG. 5 shows a flow diagram of a method for maintaining a predictive monitoring system for a $NO_x$ emission rate in accordance with an embodiment of the present invention.

Referring to FIG. 5, an embodiment of a method for maintaining a predictive monitoring system for a $NO_x$ emission rate is shown. The method comprises: a step S30, calibrating a non-continuous, natural gas-fired boiler during operation; a step S35, calibrating the predictive monitoring system; a step S40, recording data related to either of the natural gas-fired boiler or the predictive monitoring system during calibration; and a step S45, reporting the data related to either of the natural gas-fired boiler or the predictive monitoring system resulting from calibration. In an embodiment, steps S30-S45 may be performed by system maintainer 80 of computer system 20, see FIG. 1.

Referring to step S30 of FIG. 5, and the illustrative environment and computer infrastructure of FIG. 1, calibrator 82 may calibrate boiler 100, and in particular, oxygen analyzer 130. Calibrator 82 may perform a two point (zero and span) calibration of oxygen analyzer 130 at least once during operation of boiler 100 during an operating day of boiler 100. A boiler operating day may be defined as a day (24 clock hour period) when any amount of fuel is fired in boiler 100. In addition, calibration may be conducted on oxygen analyzer 130 on a business day prior to an anticipated boiler 100 start-up to ensure that oxygen analyzer 130 is operating within required specifications prior to boiler 100 start-up. In an embodiment, calibration of oxygen analyzer 130 may be manually initiated. In another embodiment, oxygen analyzer 130 calibration may be automatically initiated via computer system 20 and/or system maintainer 80. As outlined herein, oxygen analyzer 130 may be re-linearized following completion of calibration.

Re-linearizing oxygen analyzer 130 may include introduction of two calibration gases to the system manifold and directed to a sensor cell in a probe sensor assembly. Certified gases may be used for the daily calibrations for the zero gas and for the span gas when compressed bottled air is used for the span. The zero gas may have a concentration of approximately 0% to 1% oxygen. The span gas may have a concentration of approximately 20.9% oxygen (equivalent to fresh ambient air). In another embodiment, instrument air is used in lieu of a compressed gas standard for the span. In another embodiment, the minimum pressure for any daily calibration cylinder used may be 200 psi. A calibration gas cylinder will not be used and will be replaced when it reaches this pressure. In an embodiment, calibrator 82 may perform the foregoing linearization.

Referring to step S40 of FIG. 5 and the illustrative environment and computer infrastructure of FIG. 1, an embodiment of recording data by data recorder 84 is shown in Table 4. Table 4 lists a summary of daily oxygen analyzer 130 calibration data that may be recorded. Corrective actions that may need to be taken by calibrator 82 are also provided in Table 4.

TABLE 4

Daily Oxygen Analyzer Calibration Check Criteria and Corrective Actions.

| Calibration Result[a] | Action Required | PEMS in-Control?[b] |
|---|---|---|
| Less than 0.5% $O_2$ | No action required | Yes |
| Greater than 0.5% but less than 1.0% $O_2$ | No action required | Yes |
| Greater than 1.0% $O_2$ but less than 2.0% $O_2$ | Analyzer adjustment | Yes |
| Greater than 2.0% $O_2$ for any single calibration | Re-calibration or repair | No |
| Greater than 1.0% for more than 5 consecutive days | Re-calibration or repair | No |

[a]Absolute difference between actual and expected calibration values

[b]PEMS remains out-of-control until a daily analyzer calibration is successfully passed.

In an embodiment, adjustments made to oxygen analyzer 130 by calibrator 82 due to calibration drifts of oxygen analyzer 130 may be recorded by data recorder 84. Daily calibration data may be recorded and may be available for review within 24 to 48 hours of calibration. In an embodiment, immediately following any corrective actions to oxygen analyzer 130 by calibrator 82, a two-point daily calibration using zero and span gas standard calibration gases may be performed by calibrator 82. In another embodiment, these calibration results may also be recorded by data recorder 84. Recorded data may be maintained and may be available for review anytime thereafter. In an event oxygen analyzer 130 malfunctions, the failed component may be replaced or repaired per the O&M manual or vendor recommendations.

If oxygen analyzer 130 needs to be taken out of service and replaced with a spare oxygen analyzer, then the procedures described herein may be followed. If oxygen analyzer 130 cannot be repaired or replaced with an identical replacement due to non-availability of current models, oxygen analyzer 130 may be replaced with an equal or improved analyzer. The procedures described herein may be followed.

Referring to step S30 of FIG. 5, and the illustrative environment and computer infrastructure of FIG. 1, a cylinder gas audit (CGA) may be conducted every three out of four operating quarters on oxygen analyzer 130 in accordance with procedures outlined in 40 C.F.R. §60, Appendix F using U.S.E.P.A., Protocol Number 1 by calibrator 82. An operating quarter is defined as a calendar quarter (January-March, April-June, July-September, and October through December) in which boiler 100 operates.

In an embodiment, due to an expected low capacity factor of boiler 100, it may not operate for several months at a time. Consistent with Appendix F, 5.1.4, during these extended downtimes when boiler 100 does not operate during a calendar quarter, it may not be necessary to perform a CGA. Additionally, a period of three operating quarters may span more than three calendar quarters. In an embodiment, no CGA may need to be performed during the operating quarter that PEMS 30 Relative Accuracy Test Audit (RATA), described infra, is conducted unless required for oxygen analyzer 130 replacement as described infra for oxygen analyzer replacement certification procedures.

CGAs may be conducted using two audit gases with concentrations of 4% to 6% and 8% to 12% oxygen. Note that to conduct the CGAs, oxygen analyzer 130 may be placed in normal operating mode and the audit gases may be directed to oxygen analyzer sensor chamber. During the CGAs, the oxygen analyzer 130 may be challenged three times with each audit gas (non successive) and the average of the analyzer response may be used to evaluate CGA results. The audit gases may be injected for a period long enough to ensure that a stable reading is obtained. In an embodiment, calibrator 82 of system maintainer 80 may perform the foregoing CGA procedures.

In an embodiment, if the results of the CGA are not within specified criteria of ±15% of the average audit value or ±5 ppm, whichever is greater, per 40 C.F.R Appendix F Section 5.2.3(2), the oxygen analyzer 130 may be classified as not functioning within operational parameters and corrective action may be taken by calibrator 82, see FIG. 1. In an embodiment, once the problem is identified and corrected, another CGA may be performed by calibrator 82.

Referring to step S30 of FIG. 5, and the illustrative environment and computer infrastructure of FIG. 1, R.A.T.A. may be conducted on oxygen analyzer 130 in the fourth operating quarter in accordance with procedures outlined in 40 C.F.R. §60, Appendix B, Performance Specifications (PS) 2 and 3. A third party contractor may conduct the oxygen analyzer 130 R.A.T.A.s. Specific R.A.T.A. test procedures are not detailed but the following section provides some general background information and reporting requirements. Further information can be found in referenced regulatory citations listed herein. In an embodiment, calibrator 82 of system maintainer 80 may perform the foregoing R.A.T.A. procedures.

The predicted $NO_x$ emission rate may be certified in units of lb $NO_x$/MMBtu and oxygen analyzer 130 may be certified in units of % oxygen on a wet basis. During the R.A.T.A.s, boiler 100 may be firing natural gas and operating at a load greater than 50 percent of rated capacity. The R.A.T.A.s may be conducted at a single operating load and normal oxygen set point for a minimum of nine (9) 21-minute operating periods.

The following may be the RATA criteria for each pollutant: $NO_x$—20% based on the reference method or 10% of the emission standard (0.1 lb/MMBtu), whichever is less restrictive, and $O_x$—one percent oxygen absolute difference.

$NO_x$ and oxygen concentrations may be determined in accordance with U.S.E.P.A. RMs 7E and 3A, respectively. Stack gas moisture may be determined in accordance with U.S.E.P.A. RM 4. Stack gas moisture content may be used by calibrator 82, see FIG. 1, to correct oxygen concentrations for stack gas moisture as the reference method oxygen values may be typically measured and reported on a dry basis. Referring to step S40 of FIG. 5, RATA results may be recorded by data recorder 84. Referring to step S45 of FIG. 5, RATA results may be included in a semiannual Excess Emission Report that may be reported to the US.E.P.A. and the New York State Department of Environmental Conversation (N.Y.S.D.E.C), when completed during the semi-annual period.

Referring to step S30 of FIG. 5, and the illustrative environment and computer infrastructure of FIG. 1, in cases where a spare oxygen analyzer may be required to be installed on a temporary basis (less than 7 boiler operating days) due to problems with the primary unit, an initial zero and span calibration may be conducted on the spare analyzer by calibrator 82. If the spare oxygen analyzer is used to monitor oxygen emissions for greater than 7 boiler operating days, a CGA may be conducted by calibrator 82, on the spare analyzer. In an embodiment, a CGA may be conducted on the primary oxygen analyzer by calibrator 82, following re-installation.

If the spare analyzer becomes the primary analyzer (permanent replacement) for boiler 100, then a 7-day drift check may be conducted and an initial CGA may be performed by calibrator 82. If a CGA was performed on this analyzer after the $7^{th}$ operating day, then this CGA may qualify as the initial CGA. A R.A.T.A. may be conducted on the replacement oxygen analyzer when operationally practical, but not later than the end of the second operating calendar quarter after installation of this permanent replacement. In an embodiment, calibration of oxygen analyzer 130 may be performed by calibrator 82 in accordance with Yokagowa Electric Corporation Instruction Manual, Model ZR202G Integrated type Zirconia Oxygen Analyzer, Document IM 11M12A01-04E.

Referring to step S30 of FIG. 5, and the illustrative environment and computer infrastructure of FIG. 1, calibrator 82 may calibrate boiler 100, and in particular, fuel flow rate meter 130. Natural gas fuel flow meter 34 may be calibrated each calendar year using a National Institute of Standards and Technology (NIST) traceable calibration reference standard. Corrective actions such as re-calibration of the transmitters, meter repair, or replacement may be conducted by calibrator 82 depending on the cause of the problem. In an event natural gas flow meter 34 malfunctions, it may be repaired or replaced per the O&M manual or vendor recommendations. In an embodiment, fuel flow meter 34 may be calibrated and maintained by calibrator 82 on an annual basis per an appropriate ISO Procedure—Inspection, Measuring, & Test Equipment. In an embodiment, the ISO procedure may provide for document control (electronic or hardcopy), calibration requirements, supplier qualification, and quality control procedures for equipment procured.

Referring to step 40 of FIG. 5, and the illustrative environment and computer infrastructure of FIG. 1, computer system 20 may monitor, record, and track all operating parameters related to PEMS 30. The parameters may include oxygen concentration readings, $NO_x$ concentration readings, and natural gas fuel flow. In an embodiment, parameters may also include data from system maintainer 80, see supra. In the event computer system 20 or a component of computer system 20 such as PEMS 30 malfunctions, any failed components may be repaired and/or replaced per manufacturer's recommendation.

Four to twenty milliamp loop checks may be performed to ensure oxygen analyzer data, $NO_x$ analyzer data, and fuel flow data is correctly measured by PEMS 30. In an embodiment, all calibrations performed and data recorded by system maintainer 80 may also be recorded by PEMS 30. In case of PEMS 30 malfunction, if data for fuel flow, oxygen readings, and $NO_x$ readings are available and can be recreated in PEMS 30, then this data may be used to record $NO_x$ emissions from the boilers. If this data cannot be recreated, then the $NO_x$ emission data for the time when PEMS 30 malfunctions shall be considered "invalid." Any PEMS 30 data considered "invalid" is not included in emission averages reported by PEMS 30. In an embodiment, PEMS 30 may generate emissions data for a minimum of 75 percent of the operating hours in each boiler-operating day, in at least 22 out of 30 successive boiler operating days according to 40 C.F.R 60.48b(f).

Referring to step S40 of FIG. 5, an embodiment of maintaining a predictive monitoring system by system maintainer 80, see FIG. 1, an example schedule of PEMS 30 maintenance activities is shown below.

First Operating Quarter
Daily $O_2$ analyzer calibrations during operating days
Start 7-day calibration drift check for each $O_2$ analyzer
Initial CGA for each $O_2$ analyzer
Second Operating Quarter
Daily $O_2$ analyzer calibrations during operating days
CGA for each $O_2$ analyzer
Third Operating Quarter
Daily $O_2$ analyzer calibrations during operating days
CGA for each $O_2$ analyzer
Fourth Operating Quarter
Daily $O_2$ analyzer calibrations during operating days
RATA for each $O_2$ analyzer and PEMS
This QA/QC test cycle for operating quarters shall repeat for the length of this permit with the exception of the one-time only 7-day calibration drift check
Additional Boiler QA/QC Testing Activities
State permit Item 5-2: NSPS 5-day test for two hours per day (each boiler) once during permit term. The same data used during a RATA test may also be used for this NSPS test data requirement.
Other PEMS QA/QC Activities
Perform $O_2$ end-to-end calibrations for each analyzer once per calendar year
Perform fuel meter end-to-end calibrations once per calendar year
Calibrate the natural gas flow sensors used for PEMS monitoring once per calendar year Referring to step S45 of FIG. 5, recorded data related to boiler 100 calibration may be reported electronically or as a hardcopy. This step may be performed by data reporter 86 of system maintainer 80.

Referring to step S45 of FIG. 5, a $NO_x$ PEMS 30 Excess Emissions Report (EER) may be submitted to per federal and/or state requirements. The EER report may contain two basic data sets; (1) $NO_x$ emissions and PEMS 30 downtime information, and (2) PEMS 30 data assessment report (DAR) including results of quarterly PEMS audits. The $NO_x$ emissions report requirements are discussed below; the PEMS DAR is described thereafter.

The EER may provide $NO_x$ emissions data for each reporting period, including periods when $NO_x$ emissions exceed the 30-operating day permit limit of 0.057 lb $NO_x$/MMBtu. Excess emissions may be defined as any 30-day rolling $NO_x$ average emission rate that exceeds permit limits, excluding start-ups, shutdowns, and malfunctions as defined under N.Y.S.D.E.C. 6 New York Codes, Rules, and Regulations (N.Y.C.R.R.) §201.5(c).

The data assessment report (DAR) may be included as part of the semi-annual EER. Results of the quarterly audits and a summary of the daily oxygen analyzer calibration checks may be included in the report. In an embodiment, the DAR may include the following information:

Facility name
Address
Facility owner/operator
Analyzer model numbers
PEMS location In another embodiment, the following information may also be provided when oxygen analyzer 130 exceeds tolerance limits:

Date and time of each out-of-control calibration
Calibration concentration (percent oxygen)
Response calibration (percent oxygen)
Drift results (percent oxygen)
Corrective action for out-of-control period The DAR may also include results of the quarterly audits. In an embodiment, the CGA information described supra may be included in the semiannual report. In another embodiment, the certification report from the R.A.T.A. subcontractor may also be in included.

In an embodiment, the following PEMS 30 reports may be maintained for a minimum of five years for review:

PEMS certification reports
PEMS quarterly cylinder gas audit reports
PEMS natural gas certifications oxygen analyzer calibration results
PEMS semiannual reports raw PEMS $NO_x$ emissions data In an embodiment, the foregoing data may be reported by data reporter 86 of system maintainer 80.

In an embodiment, in order to ensure that PEMS 30 performance and data reporting percentages remain within specified criteria, all changes or modifications to PEMS 30 components, data acquisition systems, predictive algorithms, calibration procedures, or other operational procedures may be reviewed prior to any changes being made. These modifications may be the result of system component or software upgrades, replacement of PEMS 30 components due to system degradation or malfunction, or technical improvements to the system. PEMS 30 operational and maintenance procedural changes may be in response to changes in permit requirements, regulatory agency guidelines, or requirements of newly installed instrumentation.

All PEMS 30 modifications may be assessed with respect to regulatory requirements and manufacturers specifications to assure that the accuracy of reported PEMS data 32 would not be affected by the modification. Any proposed modifications may also be reviewed to determine if subsequent audit procedures are warranted as a result of the modification. Since boiler 100 may be permitted under a N.Y.S.D.E.C. state-issued permit, all modifications to the PEMS 30 may be evaluated within N.Y.C.R.R. to determine an application requesting such permit modifications and receive department authorization prior to making such modifications is required to be submitted.

In an embodiment, any changes and modifications which meet the criteria under subparagraphs (i)-(iii) of N.Y.C.R.R. Subpart 201-5.4 may be conducted without prior approval of the regulatory department and may not require modification of the permit. Records of the date and description of such changes may be maintained and such records may be available for review by department representatives upon request. In an embodiment, such changes and modifications are listed below.

(i) Changes that do not cause emissions to exceed any emission limitation contained in regulations or applicable requirements under this Title.
(ii) Changes which do not cause the source to become subject to any additional regulations or requirements under this Title.
(iii) Changes that do not seek to establish or modify a federally-enforceable emission cap or limit.

In addition to the recordkeeping required under paragraph (1) of this subdivision, the permittee may notify the department in writing at least 30 calendar days in advance of making changes involving:

(i) the relocation of emission points within a facility;
(ii) the emission of any air pollutant not previously authorized or remitted in accordance with a permit issued by the department;
(iii) the installation or alteration of any air cleaning installations, device or control equipment.

A permit modification may be required to impose applicable requirements or special permit conditions if it is determined that changes proposed pursuant to notification under paragraph (2) of this subdivision do not meet the criteria under paragraph (1) of this subdivision or the change may have a significant air quality impact. In such cases it may be required that the permittee not undertake the proposed change until a more detailed review of the change for air quality impacts and/or applicable requirements is completed. A response may be made to a permittee in writing with such a determination within 15 days of receipt of the 30 day advance notification from the permittee. A determination may include a listing of information necessary to further review the proposed change.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 wt %, or, more specifically, about 5 wt % to about 20 wt %", is inclusive of the endpoints and all intermediate values of the ranges of "about 5 wt % to about 25 wt %," etc).

The following codes and regulations are herein incorporated by reference in their entirety: Subpart DB C.F.R. and E.P.A. rules (60.48b and 60.49b); [72 Federal Register (F.R.) 32742, Jun. 13, 2007, as amended at 74 F.R. 5089, Jan. 28, 2009]; 60.8 regulations: [36 F.R. 24877, Dec. 23, 1971, as amended at 39 F.R. 9314, Mar. 8, 1974; 42 F.R. 57126, Nov. 1, 1977; 44 F.R. 33612, Jun. 11, 1979; 54 F.R. 6662, Feb. 14, 1989; 54 F.R. 21344, May 17, 1989; 64 F.R. 7463, Feb. 12, 1999; 72 F.R. 27442, May 16, 2007]; 60.13 regulations: [40 F.R. 46255, Oct. 6, 1975; 40 F.R. 59205, Dec. 22, 1975, as amended at 41 F.R. 35185, Aug. 20, 1976; 48 F.R 13326, Mar. 30, 1983; 48 F.R. 23610, May 25, 1983; 48 F.R. 32986, Jul. 20, 1983; 52 F.R. 9782, Mar. 26, 1987; 52 F.R. 17555, May 11, 1987; 52 F.R. 21007, Jun. 4, 1987; 64 F.R. 7463, Feb. 12, 1999; 65 F.R. 48920, Aug. 10, 2000; 65 F.R. 61749, Oct. 17, 2000; 66 F.R. 44980, Aug. 27, 2001; 71 F.R. 31102, Jun. 1, 2006; 72 F.R. 32714, Jun. 13, 2007]; [48 F.R. 13327, Mar. 30, 1983 and 48 F.R. 23611, May 25, 1983, as amended at 48 F.R. 32986, Jul. 20, 1983; 51 F.R. 31701, Aug. 5, 1985; 52 F.R. 17556, May 11, 1987; 52 F.R. 30675, Aug. 18, 1987; 52 F.R. 34650, Sep. 14, 1987; 53 F.R. 7515, Mar. 9, 1988; 53 F.R. 41335, Oct. 21, 1988; 55 F.R. 18876, May 7, 1990; 55 F.R. 40178, Oct. 2, 1990; 55 F.R. 47474, Nov. 14, 1990; 56 F.R. 5526, Feb. 11, 1991; 59 F.R. 64593, Dec. 15, 1994; 64 F.R. 53032, Sep. 30, 1999; 65 F.R. 62130, 62144, Oct. 17, 2000; 65 F.R. 48920, Aug. 10, 2000; 69 F.R. 1802, Jan. 12, 2004; 70 F.R. 28673, May 18, 2005; 71 F.R. 55127, Sep. 21, 2006; 72 F.R. 32767, Jun. 13, 2007; 72 F.R. 51527, Sep. 7, 2007; 72 F.R. 55278, Sep. 28, 2007; 74 F.R. 12580, 12585, Mar. 25, 2009; 74 F.R. 18474, Apr. 23, 2009]; and [52 F.R. 21008, Jun. 4, 1987; 52 F.R. 27612, Jul. 22, 1987, as amended at 56 F.R. 5527, Feb. 11, 1991; 69 F.R. 1816, Jan. 12, 2004; 72 F.R. 32768, Jun. 13, 2007; 74 F.R. 12590, Mar. 25, 2009].

All references to state and/or federal regulations, requirements, criteria, protocols, test procedures, reference methods, codes, and rules listed herein are herein incorporated by reference in their entirety. All references instrument manuals and operating instructions listed herein also are herein incorporated by reference in their entirety.

While shown and described herein as a method and system for predicting $NO_x$ emissions, it is understood that aspects of the invention further provide various alternative embodiments. For example, in one embodiment, the invention provides a computer program fixed in at least one computer-readable medium, which when executed, enables a computer system to predict $NO_x$ emission rates. To this extent, the computer-readable medium includes program code, such as PEMS program 30 (FIG. 1), which implements some or all of a process described herein. It is understood that the term "computer-readable medium" comprises one or more of any type of tangible medium of expression, now known or later developed, from which a copy of the program code can be perceived, reproduced, or otherwise communicated by a computing device. For example, the computer-readable medium can comprise: one or more portable storage articles of manufacture; one or more memory/storage components of a computing device; paper; and/or the like.

In another embodiment, the invention provides a method of providing a copy of program code, such as PEMS program 30 (FIG. 1), which implements some or all of a process described herein. In this case, a computer system can process a copy of program code that implements some or all of a process described herein to generate and transmit, for reception at a second, distinct location, a set of data signals that has one or more of its characteristics set and/or changed in such a manner as to encode a copy of the program code in the set of data signals. Similarly, an embodiment of the invention provides a method of acquiring a copy of program code that implements some or all of a process described herein, which includes a computer system receiving the set of data signals described herein, and translating the set of data signals into a copy of the computer program fixed in at least one computer-readable medium. In either case, the set of data signals can be transmitted/received using any type of communications link.

In still another embodiment, the invention provides a method of generating a system for predicting $NO_x$ emission rates. In this case, a computer system, such as computer system 20 (FIG. 1), can be obtained (e.g., created, maintained, made available, etc.) and one or more components for performing a process described herein can be obtained (e.g., created, purchased, used, modified, etc.) and deployed to the computer system. To this extent, the deployment can comprise one or more of: (1) installing program code on a computing device; (2) adding one or more computing and/or I/O devices to the computer system; (3) incorporating and/or modifying the computer system to enable it to perform a process described herein; and/or the like.

It is understood that aspects of the invention can be implemented as part of a business method that performs a process described herein on a subscription, advertising, and/or fee basis. That is, a service provider could offer to predict $NO_x$ emission rates as described herein. In this case, the service provider can manage (e.g., create, maintain, support, etc.) a computer system, such as computer system 20 (FIG. 1), that performs a process described herein for one or more customers. In return, the service provider can receive payment from the customer(s) under a subscription and/or fee agreement; receive payment from the sale of advertising to one or more third parties, and/or the like.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A method for predicting a nitrogen oxide ($NO_x$) emission rate of a non-continuous, natural gas-fired boiler, the method comprising:

calculating a plurality of correlations for the $NO_x$ emission rate of the non-continuous, natural gas-fired boiler relative to a plurality of measured fuel flow rates and a plurality of oxygen ($O_2$) concentrations using a computing device, wherein the plurality of correlations are based on a plurality of sampled $NO_x$ emission concentrations, sampled fuel flow rates, and sampled $O_2$ concentrations obtained during operation of the non-continuous, natural gas-fired boiler, each sampled fuel flow rate being sampled across a range of $O_2$ concentrations;

calculating a predicted $NO_x$ emission rate of the non-continuous, natural gas-fired boiler at a first fuel flow rate and a first $O_2$ concentration based on the plurality of correlations, wherein the calculating of the predicted $NO_x$ emission rate includes comparing the first fuel flow rate to the plurality of measured fuel flow rates and comparing the first $O_2$ concentration to the plurality of $O_2$ concentrations to determine a related correlation for the first fuel flow rate and the first $O_2$ concentration relative to the $NO_x$ emission rate; and providing the predicted $NO_x$ emission rate for use by a user.

2. The method of claim 1, wherein the calculating of the plurality of correlations includes sampling flue gas from the non-continuous, natural gas-fired boiler during operation at a given fuel flow rate while the $O_2$ concentration is adjusted across a range of $O_2$ concentrations.

3. The method of claim 1, additionally comprising periodically recalculating the correlation using the computerized device.

4. The method of claim 1, wherein the calculating of the predicted $NO_x$ emission rate comprises:

obtaining a fuel flow rate and a corresponding $O_2$ concentration of the non-continuous, natural gas-fired boiler during operation;

correlating the obtained fuel flow rate and corresponding obtained $O_2$ concentration with the correlation to arrive at the measured fuel flow rate and the sampled $O_2$ concentration using the computerized device; and calculating the predicted $NO_x$ emission rate based on the correlation with the measured fuel flow rate and the corresponding sampled $O_2$ concentration.

5. A predictive monitoring system for a nitrogen oxide ($NO_x$) emission rate comprising:

at least one device including:

a first calculator for calculating a plurality of correlations for the $NO_x$ emission rate of a non-continuous, natural gas-fired boiler relative to a plurality of measured fuel flow rates and a plurality of oxygen ($O_2$) concentrations, wherein the plurality of correlations are based on a plurality of sampled $NO_x$ emission concentrations, sampled fuel flow rates, and sampled $O_2$ concentrations obtained during operation of the non-continuous, natural gas-fired boiler, each sampled fuel flow rate being sampled across a range of $O_2$ concentrations; and a second calculator for calculating a predicted $NO_x$ emission rate of the non-continuous, natural gas-fired boiler at a first fuel flow rate and a first $O_2$ concentration based on the plurality of correlations, wherein the calculating of the predicted $NO_x$ emission rate includes comparing the first fuel flow rate to the plurality of measured fuel flow rates and comparing the first $O_2$ concentration to the plurality of $O_2$ concentrations to determine a related correlation for the first fuel flow rate and the first $O_2$ concentration relative to the $NO_x$ emission rate.

6. The predictive monitoring system of claim 5, wherein the predictor comprises: a correlator for correlating an obtained fuel flow rate and corresponding obtained $O_2$ concentration with the correlation to arrive at the measured fuel flow rate and the corresponding sampled $O_2$ concentration.

7. The predictive monitoring system of claim 5, wherein the monitoring system is maintained by: calibrating a non-continuous, natural gas-fired boiler during operation; calibrating the predictive monitoring system; recording data related to either of the natural gas-fired boiler or the predictive monitoring system during calibration; and reporting the data related to either of the natural gas-fired boiler or the predictive monitoring system resulting from calibration.

8. The predictive monitoring system of claim 7, wherein the calibrating comprises calibrating components of the monitoring system selected from the group consisting of: an oxygen analyzer, a computer system, and a natural gas fuel meter.

9. The predictive monitoring system of claim 7, wherein the data is selected from the group consisting of: a $NO_x$ emission concentration, fuel flow rate, flue gas oxygen concentration, downtime of the predictive monitoring system, an audit result, a certification report for the predictive monitoring system, a natural gas certification for the predictive monitoring system, a calibration result, and a semiannual report.

10. The predictive monitoring system of claim 5 additionally comprising a user interface for reporting the predicted $NO_x$ emission rate.

11. A computer program comprising program code embodied in at least one non-transitory computer-readable medium, which when executed, enables a computer system to implement a method of predicting a nitrogen oxide ($NO_x$) emission rate of a non-continuous, natural gas-fired boiler, the method comprising:

calculating a plurality of correlations for the $NO_x$ emission rate of the non-continuous, natural gas-fired boiler relative to a plurality of measured fuel flow rates and a plurality of oxygen ($O_2$) concentrations, wherein the plurality of correlations are based on a plurality of sampled $NO_x$ emission concentrations, sampled fuel flow rates, and sampled $O_2$ concentrations obtained during operation of the non-continuous, natural gas-fired boiler using a computing device, each sampled fuel flow rate being sampled across a range of $O_2$ concentrations;

calculating a predicted $NO_x$ emission rate of the non-continuous, natural gas-fired boiler at a first fuel flow rate and a first $O_2$ concentration based on the plurality of correlations, wherein calculating of the predicted $NO_x$ emission rate includes comparing the first fuel flow rate to the plurality of measured fuel flow rates and comparing the first $O_2$ concentration to the plurality of $O_2$ concentrations to determine a related correlation for the first fuel flow rate and the first $O_2$ concentration relative to the $NO_x$ emission rate; and providing the predicted $NO_x$ emission rate for use by a user.

12. The computer program of claim 11, wherein the calculating of the plurality of correlations includes sampling flue gas from the non-continuous, natural gas-fired boiler during operation at a given fuel flow rate while the $O_2$ concentration is adjusted across a range of $O_2$ concentrations.

13. The computer program of claim 11, additionally comprising periodically recalculating the correlation using the computerized device.

14. The computer program of claim 11, wherein the calculating of the predicted $NO_x$ emission rate comprises:

obtaining a fuel flow rate and a corresponding $O_2$ concentration of the non-continuous, natural gas-fired boiler during operation;

correlating the obtained fuel flow rate and corresponding obtained $O_2$ concentration with the correlation to arrive at the measured fuel flow rate and the sampled $O_2$ concentration using the computerized device; and calculating the predicted $NO_x$ emission rate based on the correlation with the measured fuel flow rate and the corresponding sampled $O_2$ concentration.

* * * * *